US007128667B2

(12) United States Patent
Nolan

(10) Patent No.: US 7,128,667 B2
(45) Date of Patent: Oct. 31, 2006

(54) ADJUSTABLE WEIGHT TRAINING BELT FOR A BASEBALL BAT

(76) Inventor: Timothy J. Nolan, 1509 Lyford Rd., Rockford, IL (US) 61107

( * ) Notice: Subject to any disclaimer, the term of this patent is extended or adjusted under 35 U.S.C. 154(b) by 0 days.

(21) Appl. No.: 10/865,224

(22) Filed: Jun. 10, 2004

(65) Prior Publication Data

US 2005/0277491 A1 Dec. 15, 2005

(51) Int. Cl.
*A63B 69/00* (2006.01)

(52) U.S. Cl. ..... 473/457; 473/422; 473/437

(58) Field of Classification Search ..... 473/437, 473/256, 451, 450, 458, 464, 564–568, 422; 273/DIG. 30; 482/105, 93, 106, 910
See application file for complete search history.

(56) References Cited

U.S. PATENT DOCUMENTS

| | | | | |
|---|---|---|---|---|
| 3,588,105 | A | 6/1971 | Donohoe | |
| 3,971,559 | A | 7/1976 | Diforte, Jr. | |
| 4,000,893 | A | 1/1977 | Evans | |
| 4,052,061 | A | 10/1977 | Stewart | |
| 4,142,721 | A | 3/1979 | Faleck et al. | |
| 4,364,560 | A | 12/1982 | Gemmel | |
| 4,371,983 | A | 2/1983 | Piotti, Jr. | |
| D270,652 | S | 9/1983 | Winston | |
| 4,538,812 | A | 9/1985 | Mugford et al. | |
| 4,588,191 | A | 5/1986 | Stewart | |
| 5,050,877 | A | 9/1991 | Wales | |
| 5,065,773 | A | 11/1991 | Jackson et al. | |
| 5,484,156 | A | 1/1996 | Giguere | |
| 5,547,445 | A | 8/1996 | Chang | |
| 5,980,397 | A * | 11/1999 | Hart et al. | 473/437 |
| 6,007,461 | A | 12/1999 | Winston | |
| 6,234,924 | B1 | 5/2001 | Washburn, Jr. | |
| 6,533,685 | B1 * | 3/2003 | Otten et al. | 473/437 |
| 6,554,752 | B1 * | 4/2003 | Cook | 482/105 |
| 6,739,989 | B1 * | 5/2004 | Liberatore | 473/457 |
| 6,758,761 | B1 * | 7/2004 | Katsuya | 473/256 |
| 2003/0224883 | A1 * | 12/2003 | Liberatore | 473/457 |
| 2003/0232668 | A1 * | 12/2003 | Liberatore | 473/457 |
| 2004/0063519 | A1 * | 4/2004 | Liberatore | 473/457 |
| 2004/0209711 | A1 * | 10/2004 | Liberatore | 473/457 |

* cited by examiner

*Primary Examiner*—Mitra Aryanpour
(74) *Attorney, Agent, or Firm*—Meroni & Meroni, P.C.; Charles F. Meroni, Jr.; Christopher J. Scott

(57) ABSTRACT

Adjustable weight training belt for use with a baseball bat comprising a first layer of flexible material and a hook and loop fastening system. The hook portion of the fastening system connected to one face and the loop portion of the fastening system on the other face, the fastening system being adjustable to adjust the area encircled by the belt. A second layer of flexible material connected to the first layer forming a plurality of pockets between the a face of the first layer and a face of the second layer. A face of the second layer has a high coefficient of friction to resist movement of the belt when placed about the barrel of a baseball bat. A plurality of malleable weights engaged in the pockets, the weights formed to the curved surface of the barrel creating a substantially similar surface profile contributing to the resistance of movement.

18 Claims, 3 Drawing Sheets

ADJUSTABLE WEIGHT TRAINING BELT FOR A BASEBALL BAT

BACKGROUND OF THE INVENTION

1. Field of the Invention

The claimed invention relates to devices used to enhance the performance of a baseball player's batting swing, and more specifically to adjustable weighted attachments for baseball bats.

2. Description of the Prior Art

Athletes train to become better players in their sport, spending hours in practicing different aspects of the sport. As an example, baseball players continually practice hitting, fielding, and base running to become a better baseball player. In the past, different types of training devices have been used that were intended to enhance the performance of an athlete, particularly in sports requiring hand held equipment such as baseball, tennis, and hockey. These devices were often developed and used based on impressions that the devices would enhance an athlete's performance without actually studying the effect that a particular device might have upon a player's performance.

One of the more popular types of training methods has been attaching weights to an athlete's hand held playing equipment such as baseball bats, tennis racquets, hockey sticks, or golf clubs. The attaching of extra weight to these types of equipment is thought to strengthen the athlete's muscles through practice while using such weighted equipment. However, placement of such weight upon the equipment has seldom been studied. In some applications, placement of extra weight upon playing equipment such as a baseball bat can actually be counter productive to the performance of the athlete due to the improper placement of the weight. If the weighted device is not secured about a baseball bat in the proper location, the extra weight can interrupt the baseball player's proper swinging form, possibly resulting in poor hitting performance. Several of the prior art weighted training devices and their disadvantages are discussed below.

U.S. Pat. No. 5,484,156, issued to Giguere discloses a Golf Club Practice Swing Weight that comprises a flexible web arranged to have secured thereto a plurality of flexible pouches. The strap member can have a hook and loop fastener surface using a ring member. The device can be mounted about a shaft, such as a golf shaft whereupon it can be secured about itself. This training device provides only a pair of weights that conforms to the curvature of the golf club shaft, but does not provide an expedient way to add or remove a discrete amount of weight having a solid, reshapeable curved surface for engagement with a rounded surface such as a handle of a baseball bat. This makes it difficult for the user or athletic trainer to accurately monitor the amount of weight being used in the training device. Further, this training device does not have a memory characteristic allowing users to reattach the training device to the golf club in the same location as previously positioned if removed. Further, this prior art does not teach the concept of employing a tacky rubber-like or rubber surface on an inner surface of a baseball bat weight training belt to resist slippage when engaged to a round baseball bat handle according to features of my invention.

Athletes often use the training device during practice sessions and then remove the training device during actual play. In prior art training devices of this type, it would be difficult if not impossible to place the training device on the golf shaft at the same location as previously placed due to the lack of formability memory training devices of this type have. This point is important in that an athlete can use and remove the training device from the golf club while being able to consistently place the training device on the club in the same location thereby providing a uniform training experience.

U.S. Pat. No. 4,538,812, issued to Mugford et al. discloses a Weight Device for Athletic Racket having two sheets separated by an elastic member. Each sheet contains a plurality of egg-shaped weights (in section) that are housed in chambers that are formed by the joining of two layers of flexible material at spaced locations. Attachment can be made using VELCRO type surfaces. This training device presents many of the same problems as previously discussed. In the embodiment shown in FIGS. 6 and 7, the training device may perhaps repeatedly be placed upon the racquet, but only due to the configuration of the racquet. This device would not be capable of being repeatedly placed upon a hand held athletic tool as shown in FIG. 5. Therefore there is a need for a weighted training device that provides for quick and easy repeatable placement of the training device upon a hand held athletic tool.

U.S. Pat. No. 4,364,560, issued to Gemmel includes a practice weight for a flat sided hockey stick that is a U-shaped weight that can be clamped onto a shaft or handle and is then clamped by clamp screws and then secured by a flexible cover that is wrapped around the shaft and itself. The clamp feature of this training device provides a device that can be removably coupled to a hockey stick while providing means for preventing the training device from shifting during use. However, this training device does not allow for easy repeatable placement of the training device upon the hockey stick. Therefore, there is a need for a training device that provides a quick and easy way to reattach a weighted training device to a hand held athletic tool in the same location as previously placed. This type of a picture weight device has not been constructed for use with a round tapered handle of a baseball bat which required different physical characteristics.

Finally, U.S. Pat. No. 4,000,893, issued to Evans teaches a weight holder and method of use that can removably add weight at selected positions on a flat sided racket and possibly a bat. The device is made of flexible material that wraps around a shaft or handle and overlaps at the ends for removable, adjustable securement and positioning. The holder comprises two, spaced pockets with a weight in each pocket and these weights can be removed to change weight size and weight. The weights disclosed in this training device are cylindrical and non-formable. Weights of this type tend to shift during use of the tennis racquet do the surface profile of the weight not being similar to the surface profile of the racquet. Therefore, there is a need for a weighted training device that provides a weight that conforms to the curvature of a hand held athletic tool that prevents the weights from shifting during use of the training device.

As athletic training methods have advanced, athletic trainers have studied the effects of different types of training devices upon the performance of an athlete. Improved technology such as slow motion imaging has helped athletes and athletic trainers to study the behavior of athletes as they perform different tasks within a sport. These advances have made athletes and athletic trainers aware that some of the training methods previously used actually hinder an athlete's performance instead of improving performance. As an example, some baseball trainers who study hitting discourage the use of the doughnut type weight that has been in use for many years due to the negative effects weighting of this kind is thought to have on a hitter's form. Therefore there is a long felt need for a weighted training device that can provide a solution to the problems previously explained in the prior art.

SUMMARY OF THE INVENTION

Accordingly, there is a need for a weighted device that can be placed about the baseball bat in a more appropriate position than that of the ordinary doughnut type weight. To satisfy this need as well as others, an objective of the claimed invention is to provide an adjustable weight training belt for use with a baseball bat.

Another object of the claimed invention is to provide an adjustable weight training belt where the amount of weight may be varied by changing the amount of weight contained with an adjustable weight training belt.

Yet another object of the claimed invention is to provide an adjustable weight training belt where the weights have formable memory allowing the adjustable weight training belt to be repeatedly placed in the same location upon the hand held athletic tool as previously placed.

A further object of the claimed invention is to provide an adjustable weight training belt where the weights are formable to prevent the weights from shifting during use.

A yet further object of the claimed invention is to provide an adjustable weight training belt where the weights are formable to prevent the training belt from moving about the surface of the hand held athletic tool.

To achieve the foregoing objectives, the claimed invention provides an adjustable weight training belt for use with a baseball bat. The belt comprises a first layer of flexible material having a front face and a back face. A hook and loop fastening system with the hook portion of the fastening system on the front face and the loop portion of the fastening system on the back face is employed to increase or decrease the area encircled by the belt.

A second layer of flexible material having a front face and a back face is connected to the first layer forming a plurality of pockets between the front face of the first layer and the back face of the second layer. The front face of the second layer has a high coefficient of friction to resist movement of the belt when placed about the barrel of a baseball bat.

A plurality of malleable weights are engaged in the pockets. The weights formable to the curved surface of the barrel of the baseball bat creating a substantially similar surface profile contributing to the resistance of movement of the training belt against the surface of the bat. The weights have a memory characteristic enabling a user to place the weights in substantially the same location along the surface of a baseball bat from one use to another by matching the surface profile of the weights to the curvature of the baseball bat. In one embodiment of the invention the malleable weights are removably engaged in the pockets. In another embodiment of the invention the pockets are sewn closed permanently retaining the malleable weights.

BRIEF DESCRIPTION OF THE DRAWINGS

FIG. 1 is a perspective view of the adjustable weight training belt.

FIG. 2 is a top view of the adjustable weight training belt.

FIG. 3 shows a solid reshapeable weight.

FIG. 4 shows a cross section of the adjustable weight training belt about a baseball bat.

FIG. 5 illustrates the placement of the adjustable weight training belt about a baseball bat.

FIG. 7 shows a preferred embodiment of the adjustable weight training belt.

FIG. 8 shows a diagrammatic illustration of a modified solid reshapeable curved weight of a tapered construction.

DETAILED DESCRIPTION OF THE PREFERRED EMBODIMENT

Figure 1:
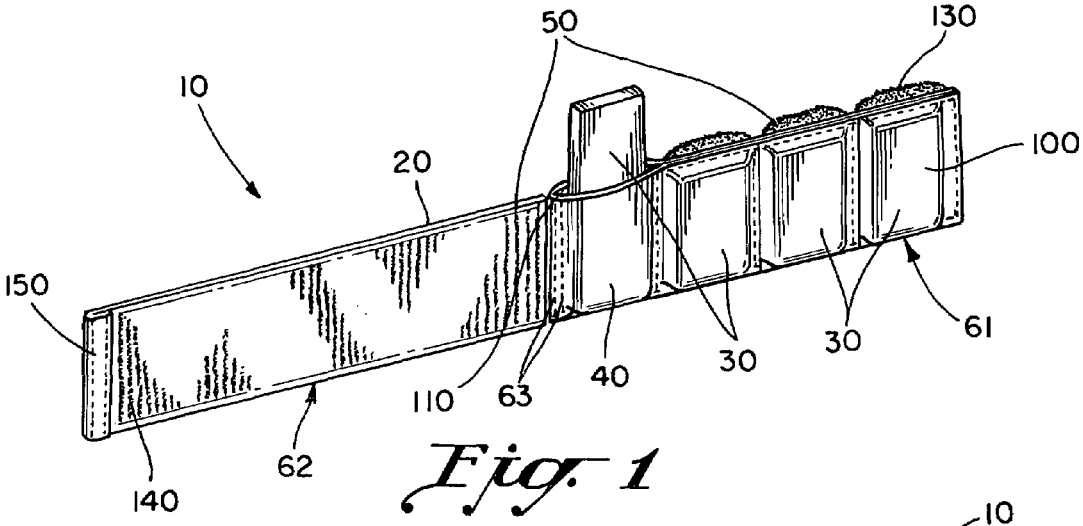
FIG. 1.
Figure 2:
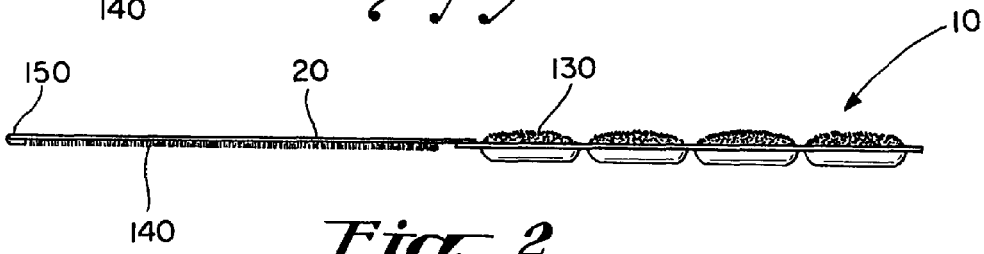
FIG. 2.

FIGS. 1, 2, 6 and 7 show the adjustable weight training belt 10. The adjustable weight training belt 10 is essentially made of four major components, a belt 20, a plurality of malleable or preferably manually reshapeable weights 30, a weight cover 40, and an adjustable fastener 50. In the preferred embodiment of the invention shown in FIG. 7, the plurality of weights 30 are removable from the training belt 10 so that the amount of weight can be varied depending upon the training needs. FIGS. 1 and 2 show an adjustable weight training belt 10 containing four 2 ounce weights 30 providing a total of 8 ounces of weight. Other embodiments of the invention will be discussed below.

FIGS. 1 and 2 show the belt 20 is preferably made of a durable, flexible material such as nylon webbing, but may be made of other durable, flexible materials such as plastic or canvass. The belt 20 is preferably about 2 inches in width, but may be configured in greater or narrower widths to support larger or smaller weights. The belt 20 is preferably about 11 inches in length, but may be shorter or longer depending upon the weights being employed with the adjustable weight training belt 10. The belt 20 preferably has sufficient length to wrap around a baseball bat 60 approximately 1½ times.

Figure 3:
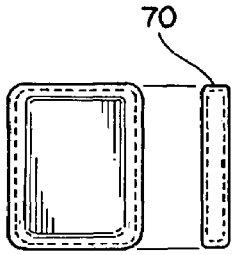
FIG. 3.
Figure 4:
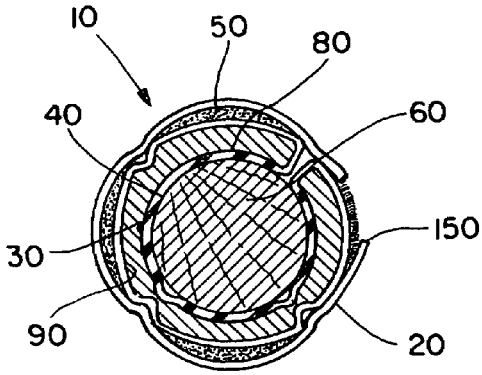
FIG. 4.

FIGS. 3 and 4 show the reshapable weights 30 are preferably made of lead covered with a non-toxic plastic coating 70, but may be made of other materials having similar weight to volume ratio and formability. FIGS. 1 and 2 show that an 8 ounce adjustable weight belt 10 has four 2 ounce weights measuring approximately 1¼ inches in length by approximately 1 inch in width by approximately ⅛ inch in thickness. The weights 30 are covered with a non-toxic coating 70 so that the toxicity of the lead will not pose a potential health problem to persons handling the weights 30 while using the training belt 10 as shown in FIG. 3. The weights 30 employed in the adjustable weight training belt 10 can range from as little as about ½ ounce to as much as about 80 ounces. The surface profile 80 of the weights 30 can be formed to conform to the curvature of the baseball bat 60 as shown in FIG. 4. The reshapeability of the weights 30 training belt 10 at a desired location upon the baseball bat 60. The curvature 90 of the weights 30 creates a greater amount of surface to surface contact between the training belt 10 and the baseball bat 60. Another purpose the reshapeable weights 30 serve is to make the training belt 10 feel more like a continuous part of the baseball bat 60 when using it in training. Due to the high surface to surface contact between the training belt 10 and the baseball bat 60, the weights 30 resist shifting when the baseball bat 60 having the training belt 10 strapped about it is swung. The weights of the prior art weighted devices tended to shift about the baseball bat due to the inability of the weights to form to the curved surface of the baseball bat.

Figure 7:
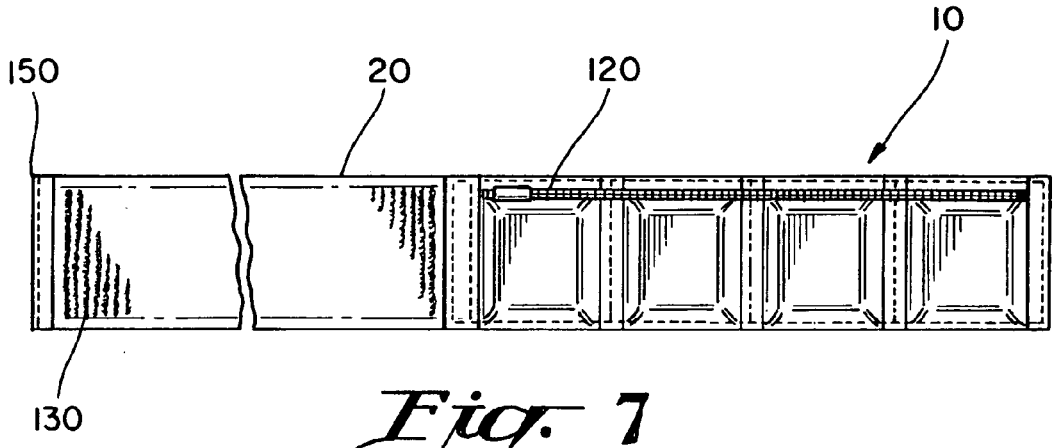
FIG. 7.

FIGS. 1, 2, and 4 show the weight cover 40 is preferably made of a flexible material having a surface with a high coefficient of friction such as rubber, but may be made of other similar materials. In my preferred embodiment, the material is ethylene propylene diene monomer which is a product sold by Firestone under the trade name RubbertGard EPDM and can be viewed on Firestone's website at: www-.FirestoneBPCO.COM. This material provides a tacky characteristic which allows the trailing belt to be snugly but removably adhered to an outside surface of a baseball bat handle. In addition, this tacky type of rubber can better grip the perimeter of the bat handle to resist slippage of the bat along the bat handle where used. Where the rubber is of a tacky type, slippage can be minimized. The weight cover 40 is preferably sewn to the belt 20 forming at least one pocket 100 between the belt 20 and the weight cover 40 for receiving the weights 30. In the preferred embodiment of the invention as shown in FIG. 7, the weight cover 40 forms four pockets 100 for receiving the weights 30 with an opening 110 at one end of each pocket 100 so that different configurations of weights 30 can be employed with the adjustable weight training belt 10. The openings 110 may have a closure such as a zipper 120 to close the pockets 100 and retain the weights 30 within the pockets 100. The distance between each of the weight pockets 100 in the training belt 10 may vary depending upon the type of baseball bat 60 the training belt 10 is designed to fit.

Figure 6:
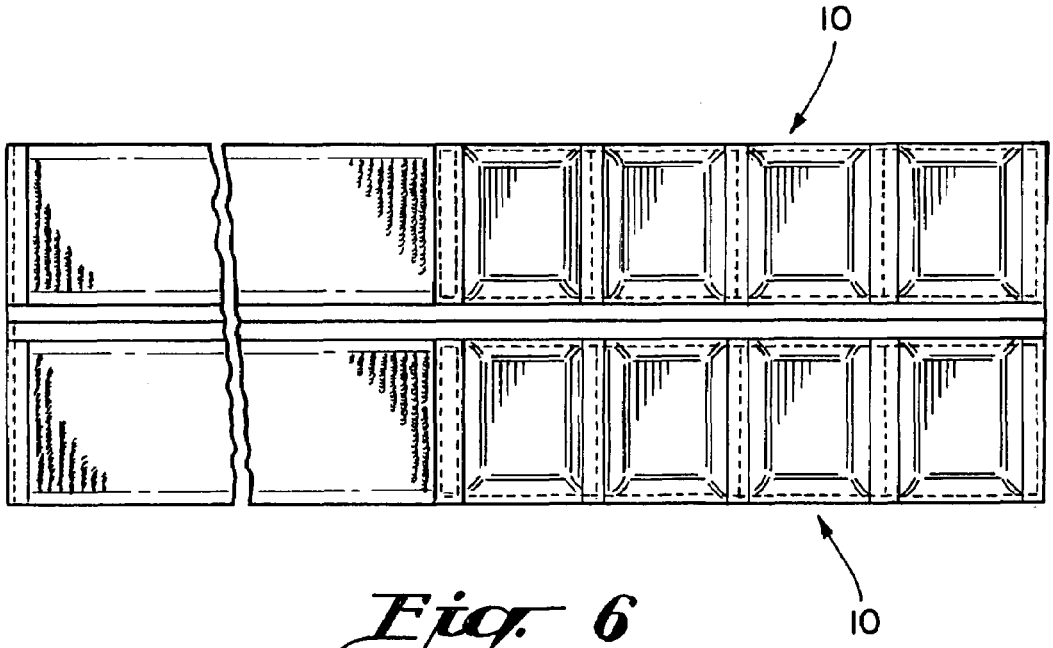
FIG. 6. Shows an alternate embodiment having two adjustable weight training belts sewn together.

In another embodiment of the invention shown in FIG. 1, the openings 110 are sewn closed so that the weights 30 are permanently retained within the training belt 10. Training belts of this type do not require the use of coated weights 30 and therefor are potentially less costly to manufacture. However, training belts 10 of this type do not allow the adjustment of the amount of weight contained in the training belt 10. Therefore, persons using a training belt 10 of this configuration would either have to purchase additional training belts 10 of differing weight or would have to combine the weight of more than one training belt 10 to achieve the amount of weight desired. FIG. 6 illustrates in this particular embodiment, more than one adjustable weight training belt 10 is employed to adjust the amount of weight being used during weight training. These additional weight belts may be separately strapped to the baseball bat 60 or a plurality of belts may be sewn together forming one training belt 10. It is contemplated for ease of manufacturing purposes that one training belt 10 containing a standard amount of weight would be produced, and a plurality of these belts could be sewn together and sold to provide training belts of differing weight while achieving the desired economy of scale by producing many of the same configuration of training belt 10.

FIGS. 1, 2 and 4 show the adjustable fastener 50 is preferably VELCRO, but may be other types of fastening devices such as a series of snaps. The hook 130 and loop 140 portions of the VELCRO are sewn to opposite sides of the belt 20 so that the training belt 10 can be properly secured to the baseball bat 60 by wrapping the training belt 10 upon itself as shown in FIG. 4. The end of the training belt 10 opposite the weighted portion has a pull tab 150 to facilitate the removal of the training belt 10 from the baseball bat 60. The VELCRO allows the user of the adjustable weight training belt 10 to secure it about a baseball bat 60 at different locations along the barrel of the bat 60. The VELCRO also allows the use of the adjustable weight training belt 10 on baseball bats 60 of many different sizes.

Figure 5:
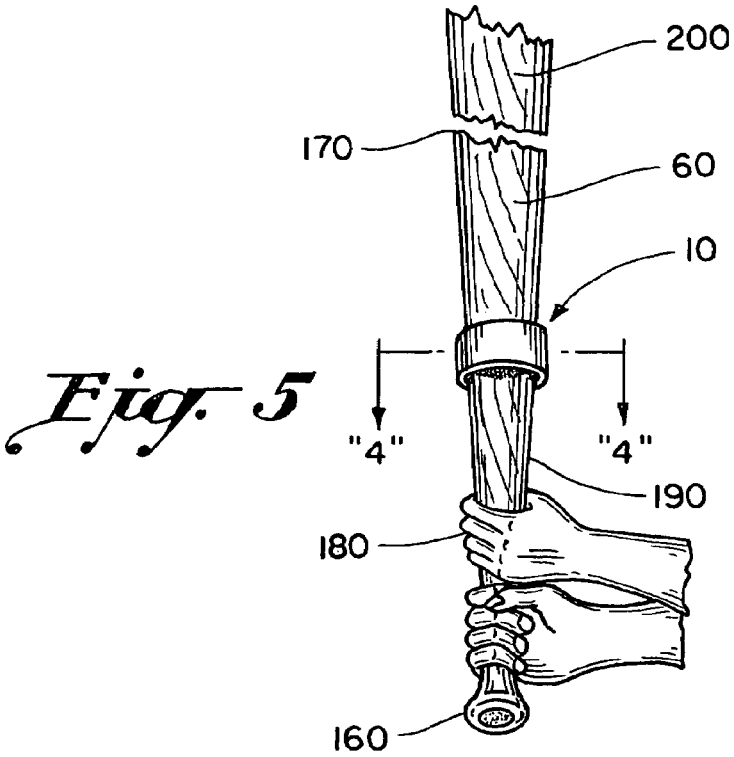
FIG. 5.

The VELCRO fastener 50 allows use of the training belt 10 on full sized wooden and metal bats as well as smaller bats sized for youth baseball. The belt 10 is sized and shaped to enable it to be placed preferably from about ½ inch to about 8 inches from the grip of the person holding the baseball bat 60 as shown in FIG. 5. Excellent results can be attained where the belt has a length of about 11 inches which enables the belt to be securely attached to the handle of the bat where pocketed weighted end 61 is slightly longer than unpocketed end 62. The unpocketed end 62 can be suitably attached to the weighted pocketed end 61 by a double row of stitching as shown at 63—63 in FIG. 1 when ends 61 and 62 are positioned in end-to-end relation. There is an advantage to having ends 61 and 62 secured in end-to-end relation so that when lap engaged a greater area of hooks and loops can be connected to provide a stronger connection to hold the belt on the bat handle. As illustrated, the weighted pocketed end 61 is comprised of two layers of flexible material—which are sewn together with horizontal lines of stitches and at longitudinally spaced intervals by vertical lines of stitches to for pockets for the weights.

When assembled, the first and second layers are positioned in superimposed relation to provide the belt with the pocketed weighted end 61, and an elongated unpocketed end 62 is attached in end-to-end relation to said pocketed weighted end 61. The hooks being on one side of the belt and with the loops being on an opposite side enable said unpocketed end 62 to be attached to said pocketed weighted end 61 on an outside surface area of said pocketed weighted end 61 when position in lapped relation to one another when attached to a bat handle.

The unpocketed end of the belt has a length almost as long as the weighted pocketed end of the belt to provide a relatively large area of engaged hooks and loops to ensure that the weights will be secured in tight engagement with the bat handle. The large area in my preferred embodiment can be approximately 4¾ inch by approximately 2 inches to provide a very solid connection.

Due to the various types of grips employed from one baseball player to another as well as from one situation to another, the adjustable weight training belt 10 may need to be placed close to the knob 160 of the bat 60 or close to the hitting area 170 of the bat 60. The placement of the training belt 10 above the hands 180 of the athlete positions the training belt 10 in a more balanced location than that of the prior art devices previously discussed in the background of the invention section. Since the training belt 10 is placed in a more properly balanced location upon the baseball bat 60, the added weight of the training belt 10 does not interfere with the swinging form of the athlete. The ability to form the training belt 10 to the curvature 190 of the tapered handle of a baseball bat 60 and along any part of the bat 60 gives the claimed invention an important advantage over the prior art. The prior art does not provide means for conforming a training device to a hand held athletic tool while also providing means for allowing a user to remove the training device and reliably place the training device back on the hand held athletic tool in the same location as previously placed.

The training belt 10 is generally used by first shaping the malleable weights 30 so that the surface profile 80 of the weights 30 are substantially similar to the curvature 190 of the baseball bat 60 as shown in FIG. 4. This can be accomplished by placing the malleable weights 30 against the head 200 of the baseball bat 60 and then forming them to the curvature 190 by applying force to the weights 30 such as the user pushing upon the weights 30 with the user's thumb or tapping the outside of the training belt 10 with a hammer to form each of the weights 30 to a desired configuration.

After the weights 30 have been properly formed, the weighted portion of the training belt 10 is placed against the head 200 of the bat 60 from about ½ inch to about 8 inches above the hands 180 of the athlete using the bat 60 as shown in FIG. 5. The preferred position for the belt is on the bat handle but spaced from the hook 130 of the belt 10. The remainder of the training belt 10 is then wrapped around the bat 60, the hook 130 and loop 140 fastener securing the training belt 10 about the bat 60 and the rubber fabric on an inner side of the belt provides resistance to slippage of the training belt 10 against the bat 60.

It is contemplated that my adjustable weight training belt can be of several different sizes. As stated in one embodiment, I have four lead weights, each having approximately a 1 inch width and each are approximately ⅛ inch thick. The total weight of the four weights is 4 ounces.

I also contemplate a so-called 8 ounce bat belt where the pockets will be enlarged and the bent will be wider to accommodate larger weights, each of 2 ounces having a ⅛ inch thickness, a 1 inch width and each being approximately 2 or 3 inches in length.

My training belt 10 can be approximately 11 inches in width with the so-called pocket end of the belt being 6 inches and with an unpoeketed opposite end being approximately 5 inches in length. The unpocketed end is lap engaged on the pocketed end and is sewn with two lines of stitching to connect the pocketed end with the unpocketed end. Tacky rubberized fabric or rubber is provided on the pocketed end and the unpocketred end has a hook side which is positioned on the same side of the belt as the tacky rubberized surface. The pocketed end has a loop side opposite to its tacky rubberized side so that when the belt is wrapped about the handle of a bat, the hook and loop faces or sides will be confronting for lapping engagement as shown in the drawings. The hook and loop face can be attached and reattached as the user adjusts the position of the handle and as the user squeezes the weights to conform the weights to the tapered shape of the bat handle, thus assuring that the tacky rubberized surface can gain a firm grip on the exterior surface of the bat handle. Once adjusted to a desired position, the training belt can then be used with the bat to enable a user to engage in a training exercise to improve the user's batting stroke.

Figure 8:
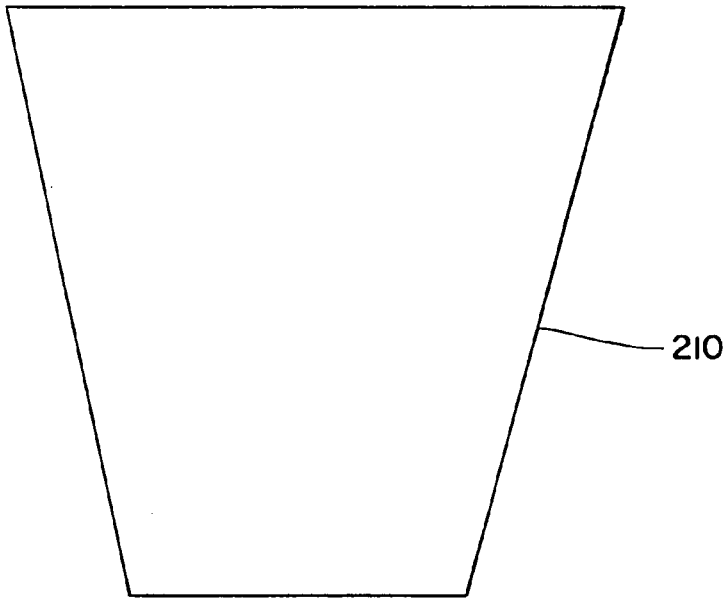
FIG. 8.

In FIG. 8 I have diagrammatically illustrated a reshapeable tapered weight which is indicated as 210. This weight is configured to allow for the tapered weight to be located on the handle of a bat so that the low reduced end of the tapered weight would be located in closest proximity to the knob end of a baseball bat. My tapered weight has a curved cross-section as disclosed and discussed before and as illustrated in FIG. 4. Since a baseball bat has a tapered shape from end to end, the curved tapered weights are better adapted to nestingly engage with a curbed taper bat handle where the tapered bat handle is of gradually increasing diameter from a knob end of the bat to its opposite end.

It will thus be seen that the present invention contemplates an adjustable weight training belt for use with a baseball bat, which belt comprises a first and second layer of flexible material, and a number of hand-moldable, solid, cubic members cooperatively associated with the materials. The first layer of flexible material has a front face, a back face, and a hook and loop fastening system. The hook portion of the fastening system may preferably be located on the front face and the loop portion of the fastening system may preferably be located on the back face. The fastening system is adjustable to increase or decrease the area encircled by the belt.

The second layer of flexible material has a front face and a back face, and is connected to the first layer forming at least one, but preferably, a plurality of pockets between the front face of the first layer and the back face of the second layer. The front face of the second layer preferably comprises certain high friction materials such as rubber to resist movement of the belt when placed about a baseball bat. As will be seen from a comparative inspection of FIG. 4 and 5, the baseball bat 60 inherently has a circular transverse bat cross-section.

A hand-moldable, solid, cubic material or member is received in each pocket, which cubic material has a certain mass (lead being massive, relatively soft, formable material) and a rectangular transverse material configuration as may be gleaned from a comparative inspection of FIG. 3 and 4. The rectangular transverse material configuration has a bat-opposing arcable first side as may be seen at surface profile 80. The arcable first side is moldable to the circular transverse bat cross-section at a select bat surface position.

The moldable arcable first side thus function to form a unique surface position mold which mold is contour-retentive. The contour-retentive surface position mold retains its contour during swinging bat usage thereby resisting mold movement and enabling matched mold-replacement at the select bat surface position with intermittent bat usage. Preferably, the cubic material comprises lead having a combined weight ranging from about four ounces to about twenty ounces for selectively increasing the weight of the bat thereby at the perimeter of the circular transverse bat cross-section for training purposes as previously set forth.

As noted, four hand-moldable, solid, cubic member are preferably receivable by an adjustable belt (such as belt 10) to be wrapped about baseball bat 60 at the select circular transverse bat cross-section. The four weights 30 or cubic members are similarly sized and shaped as may be seen from an inspection of FIG. 4. and comprise an transverse center, the transverse centers being located substantially 90 rotational degrees from one another when wrapped bout the baseball bat 60 as further generally illustrated or depicted in FIG. 4 and 5. It is contemplated that the spatial orientation of the transverse centers may effectively function to balance the transverse weight of the bat at the select circular transverse bat cross-section.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. An adjustable weight training belt for use with a baseball bat, the belt comprising:

a first layer of flexible material having a front face, a back face, and a hook and loop fastening system, the hook portion of the fastening system on the front face and the loop portion of the fastening system on the back face, the fastening system being adjustable to increase or decrease the area encircled by the belt;

a second layer of flexible material having a front face and a back face, the second layer connected to the first layer forming a plurality of pockets between the front face of the first layer and the back face of the second layer, the front face of the second layer having a rubberized surface to resist movement of the belt when placed about a baseball bat, the baseball bat having a circular transverse bat cross-section; and at a hand-moldable, solid, cubic material received in each pocket, the cubic material having mass and a rectangular transverse material configuration, the rectangular transverse material configuration having a bat-opposing arcable first side, the arcable first side being moldable to the circular transverse bat cross-section at a select bat surface position, the moldable arcable first side thus forming a unique surface position mold, the surface position mold being contour-retentive, the contour-retentive surface position mold retaining its contour during swinging bat usage thereby resisting mold movement, the contour-retentive surface position mold enabling belt-replacement at the select bat surface position with intermittent bat usage.

2. The belt of claim 1 wherein the surface position molds are sized and shaped to encompass and to engage the perimeter of the circular transverse bat cross-section when the belt is attached thereto.

3. The belt of claim 2 wherein the cubic material comprises lead having a combined weight ranging from about four ounces to about twenty ounces for selectively increasing the weight of the bat thereby at the perimeter of the circular transverse bat cross-section.

4. The belt of claim 3 wherein the second layer of flexible material is made of rubber.

5. The belt of claim 4 wherein the first layer of flexible material is made of nylon webbing.

6. The belt of claim 3 wherein the leaden cubic material is coated with a flexible non-toxic material for preventing lead toxicity when handling the leaden cubic material.

7. A weight training belt for use with a hand held athletic tool, the belt comprising:

a first layer of flexible material having a front face, a back face, and a two part fastening means, one part of the fastening means on the front face and the second part of the fastening means on the back face;

a second layer of flexible material connected to the first layer forming at least one pocket between a face of the first layer and the second layer, at least one face of the second layer having a high coefficient of friction to resist movement of the belt when placed about the athletic tool, the athletic tool having a transverse tool cross-section; and at least three hand-moldable, solid, cubic members received in the pocket, the cubic members each having mass and a rectangular transverse material configuration, the rectangular transverse material configurations each having a tool-opposing moldable first side, the moldable first sides being moldable to the transverse bat cross-section at a select tool surface position, the moldable first sides each forming a unique surface position mold, the surface position molds being contour-retentive, the contour-retentive surface position molds retaining their contour during athletic tool usage thereby resisting mold movement, the contour-retentive surface position molds enabling belt-replacement at the select tool surface position with intermittent athletic tool usage.

8. The belt of claim 7 wherein the two part fastening means is adjustable to increase or decrease the area encircled by the belt.

9. The belt of claim 8 wherein the fastening means is a hook and loop fastening system, the hook portion of the fastening system on the front face of the first layer and the loop portion of the fastening system on the back face of the first layer.

10. The belt of claim 9 wherein the surface position molds are sized and shaped to encompass and to engage the perimeter of the transverse tool cross-section when the belt is attached thereto.

11. The belt of claim 10 wherein the second layer of flexible material is made of neoprene rubber.

12. The belt of claim 11 wherein the cubic members comprise lead having combined weight ranging from about four ounces to about twenty ounces for selectively increasing the weight of the athletic tool thereby at the perimeter of the transverse tool cross-section.

13. The belt of claim 12 wherein each leaden cubic member is coated with a flexible non-toxic material for preventing lead toxicity when handling the leaden cubic members.

14. In combination, an adjustable weight training belt and a baseball bat, the combination comprising:

a baseball bat, the baseball bat having a select circular transverse bat cross-section;

an adjustable weight belt for selective attachment to the baseball bat at the circular transverse bat cross-section, the adjustable weight belt comprising a first and second layer of flexible material, the first layer of flexible material having a front face, a back face, and a hook and loop fastening system, the hook portion of the fastening system on the front face and the loop portion of the fastening system on the back face, the fastening system adjusting the belt to the size of the select circular transverse bat cross-section baseball bat the second layer of flexible material having a front face and a back face, the second layer connected to the first layer forming a plurality of pockets between the front face of the first layer and the back face of the second layer, the front face of the second layer having a rubberized tacky surface to resist movement of the belt relative to the select circular transverse bat cross-section; and at least one hand-moldable, solid, cubic member received in each pocket, the cubic members each having mass and a rectangular transverse material configuration, the rectangular transverse material configuration each having a bat-opposing arcable first side, the arcable first sides being moldable to the circular transverse bat cross-section at a select bat surface position, the moldable arcable first sides thus forming a plurality of unique surface position molds, the surface position molds being contour-retentive, the contour-retentive surface position molds retaining their contour during swinging bat usage thereby resisting mold movement, the contour-retentive surface position mold enabling belt-replacement at the select bat surface position with intermittent bat usage.

15. The combination of claim 14 wherein the first and second layers are in superimposed relation to provide the belt with a pocketed weighted end, and an elongated unpocketed end being attached in end-to-end relation to said pocketed weighted end, the hooks being on one side of the belt and with the loops being on an opposite side enabling said unpocketed end to be attached to said pocketed weighted end on an outside surface area of said pocketed weighted end when positioned in lapped relation to one another when attached to the select circular transverse bat cross-section.

16. The combination of claim 15 wherein the unpocketed end of the belt has a length almost as long as the weighted unpocketed end of the belt to provide a relatively large area of engaged hooks and loops to ensure that the cubic members will be secured in tight engagement with the select circular transverse bat cross-section.

17. The combination of claim 16 wherein the cubic members comprise lead having combined weight ranging from about four ounces to about twenty ounces for selectively increasing the weight of the baseball bat thereby at the perimeter of the select circular transverse bat cross-section.

18. The combination of claim 17 wherein each leaden cubic member is coated with a flexible non-toxic material for preventing lead toxicity when handling the leaden cubic members.

* * * * *